US009283761B2

(12) United States Patent
Miyazaki

(10) Patent No.: US 9,283,761 B2
(45) Date of Patent: Mar. 15, 2016

(54) INK-JET RECORDING HEAD, RECORDING ELEMENT SUBSTRATE, METHOD FOR MANUFACTURING INK-JET RECORDING HEAD, AND METHOD FOR MANUFACTURING RECORDING ELEMENT SUBSTRATE

(71) Applicant: CANON KABUSHIKI KAISHA, Tokyo (JP)

(72) Inventor: Hirotaka Miyazaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/255,857

(22) Filed: Apr. 17, 2014

(65) Prior Publication Data

US 2014/0227808 A1 Aug. 14, 2014

Related U.S. Application Data

(60) Continuation of application No. 13/604,545, filed on Sep. 5, 2012, now Pat. No. 8,789,928, which is a division of application No. 12/636,001, filed on Dec. 11, 2009.

(30) Foreign Application Priority Data

Dec. 17, 2008 (JP) ..... 2008-320928

(51) Int. Cl.
*B41J 2/05* (2006.01)
*B41J 2/16* (2006.01)

(52) U.S. Cl.
CPC ..... *B41J 2/1635* (2013.01); *B41J 2/1603* (2013.01); *B41J 2/1628* (2013.01); *B41J 2/1632* (2013.01); *B41J 2202/20* (2013.01); *Y10T 29/49401* (2015.01)

(58) Field of Classification Search
USPC ..... 347/68–72; 400/124.14, 124.16; 310/311, 324, 327; 29/25.35; 438/21
See application file for complete search history.

(56) References Cited

U.S. PATENT DOCUMENTS 7,891,784 B2 * 2/2011 Ozaki et al. ..... 347/71

FOREIGN PATENT DOCUMENTS

| | | | |
|---|---|---|---|
| CN | 001880080 | A | 12/2006 |
| EP | 0367541 | B1 | 10/1994 |
| EP | 0677387 | A2 | 10/1995 |

* cited by examiner

*Primary Examiner* — Kristal Feggins
(74) *Attorney, Agent, or Firm* — Canon U.S.A., Inc. IP Division

(57) ABSTRACT

An ink-jet recording head includes a plurality of recording element substrates each having an ejection pressure generating element configured to generate pressure for ejecting ink from an ink discharge port. The plurality of recording element substrates each include a first surface on which the corresponding ejection pressure generating element is disposed and a second surface, serving as an end surface intersecting with the first surface, being at least partially formed by etching.

6 Claims, 6 Drawing Sheets

INK-JET RECORDING HEAD, RECORDING ELEMENT SUBSTRATE, METHOD FOR MANUFACTURING INK-JET RECORDING HEAD, AND METHOD FOR MANUFACTURING RECORDING ELEMENT SUBSTRATE

CROSS-REFERENCE TO RELATED APPLICATIONS

This application is a continuation of U.S. patent application Ser. No. 13/604,545 filed Sep. 5, 2012, which is a divisional of U.S. patent application Ser. No. 12/636,001 filed Dec. 11, 2009, which claims the benefit of Japanese Patent Application No. 2008-320928 filed Dec. 17, 2008, all of which are hereby incorporated by reference herein in their entirety.

BACKGROUND OF THE INVENTION

1. Field of the Invention

The present invention relates to ink-jet recording heads, recording element substrates, methods for manufacturing ink-jet recording heads, and methods for manufacturing recording element substrates.

2. Description of the Related Art

Known full-line ink-jet recording heads are manufactured by aligning a plurality of recording element substrates composed of, for example, silicon or glass such that the recording element substrates are brought into contact with each other at end surfaces thereof (European Patent No. 0376514). However, since the recording element substrates are aligned by being brought into contact with each other in this method of manufacturing the full-line ink-jet recording heads, variations in accuracy in cutting the recording element substrates directly correspond to the accuracy of discharge port arrangement.

To avoid this, Japanese Patent Laid-Open No. 8-127127 describes an ink-jet recording head, including a plurality of recording element substrates disposed on a supporting member so as to be separated from one another, capable of reducing the variations in the accuracy in cutting the recording element substrates by changing the intervals between the substrates in accordance with the variations. Since the cutting accuracy of dicing machines that cut the recording element substrates is about ±15 μm, the possible density of discharge ports is about 360 dpi with consideration of the width of walls of ink ejecting nozzles, the diameter of the discharge ports, and the like.

However, in order to meet the recent demand for ink-jet recording heads with higher recording speed and higher image quality from the market, the number of the discharge ports is being increased from 64 or 128, to 256, for example, and the density of the discharge ports is also being increased from 300 dpi to 600 dpi, for example. That is, it becomes more difficult to reduce the variations in the accuracy in cutting the recording element substrates using the known method of changing the distance between the substrates in accordance with variations since the intervals between the discharge ports are being reduced.

SUMMARY OF THE INVENTION

The present invention is directed to an ink-jet recording head, a recording element substrate, a method for manufacturing an ink-jet recording head, and a method for manufacturing a recording element substrate, capable of readily satisfying the accuracy required for bonding recording element substrates having densely arranged discharge ports.

According to a first aspect of the present invention, an ink discharge port, and an ink-jet recording head includes a plurality of recording element substrates each having an ejection pressure generating element configured to generate pressure for ejecting ink from the ink discharge port. The plurality of recording element substrates each include a first surface on which the corresponding ejection pressure generating element is disposed and a second surface, serving as an end surface intersecting with the first surface, being at least partially formed by etching.

According to a second aspect of the present invention, a recording element substrate includes an ink discharge port and an ejection pressure generating element configured to generate pressure for ejecting ink from the ink discharge port. The recording element substrate includes a first surface on which the ejection pressure generating element is disposed and a second surface, serving as an end surface intersecting with the first surface, being at least partially formed by etching.

According to a third aspect of the present invention, a method for manufacturing an ink-jet recording head, the head including a recording element substrate formed on a supporting member, includes preparing the recording element substrate, the substrate having an ejection pressure generating element disposed on a main surface of the substrate configured to generate pressure for ejecting ink, a side surface of the main surface being at least partially subjected to etching; bringing the etched side surface of the recording element substrate into contact with a positioning portion configured to position the recording element substrate; and fixing the recording element substrate to the supporting member while the etched side surface of the recording element substrate and the positioning portion are in contact with each other.

According to a fourth aspect of the present invention, a method for manufacturing a recording element substrate, the substrate having an ejection pressure generating element configured to generate pressure for ejecting ink from an ink discharge port, includes preparing the recording element substrate having the ejection pressure generating element on a first surface of the recording element substrate and at least partially applying etching to a second surface serving as an end surface of the recording element substrate intersecting with the first surface.

According to the ink-jet recording head, the recording element substrate, the method for manufacturing the ink-jet recording head, and the method for manufacturing the recording element substrate of the present invention, the second surface, intersecting with the first surface having the ink discharge port and forming a side surface of each recording element substrate, is at least partially subjected to etching. Since the second surface subjected to etching is corrosion-resistant, the surface accuracy of the second surface can be ensured. Therefore, the accuracy of the relative positions of a plurality of recording element substrates when they are bonded can be ensured by bringing the recording element substrates into contact with each other at the second surfaces whose surface accuracy is ensured. As a result, the accuracy of the distances between the ink discharge ports arranged in the recording element substrates can also be ensured, and the ink-jet recording head can support the accuracy required for bonding the recording element substrates even when a plurality of discharge ports are densely arranged in each substrate.

Further features of the present invention will become apparent from the following description of exemplary embodiments with reference to the attached drawings.

DESCRIPTION OF THE EMBODIMENTS

Exemplary embodiments of the present invention will now be described with reference to the drawings.

Figure 1:
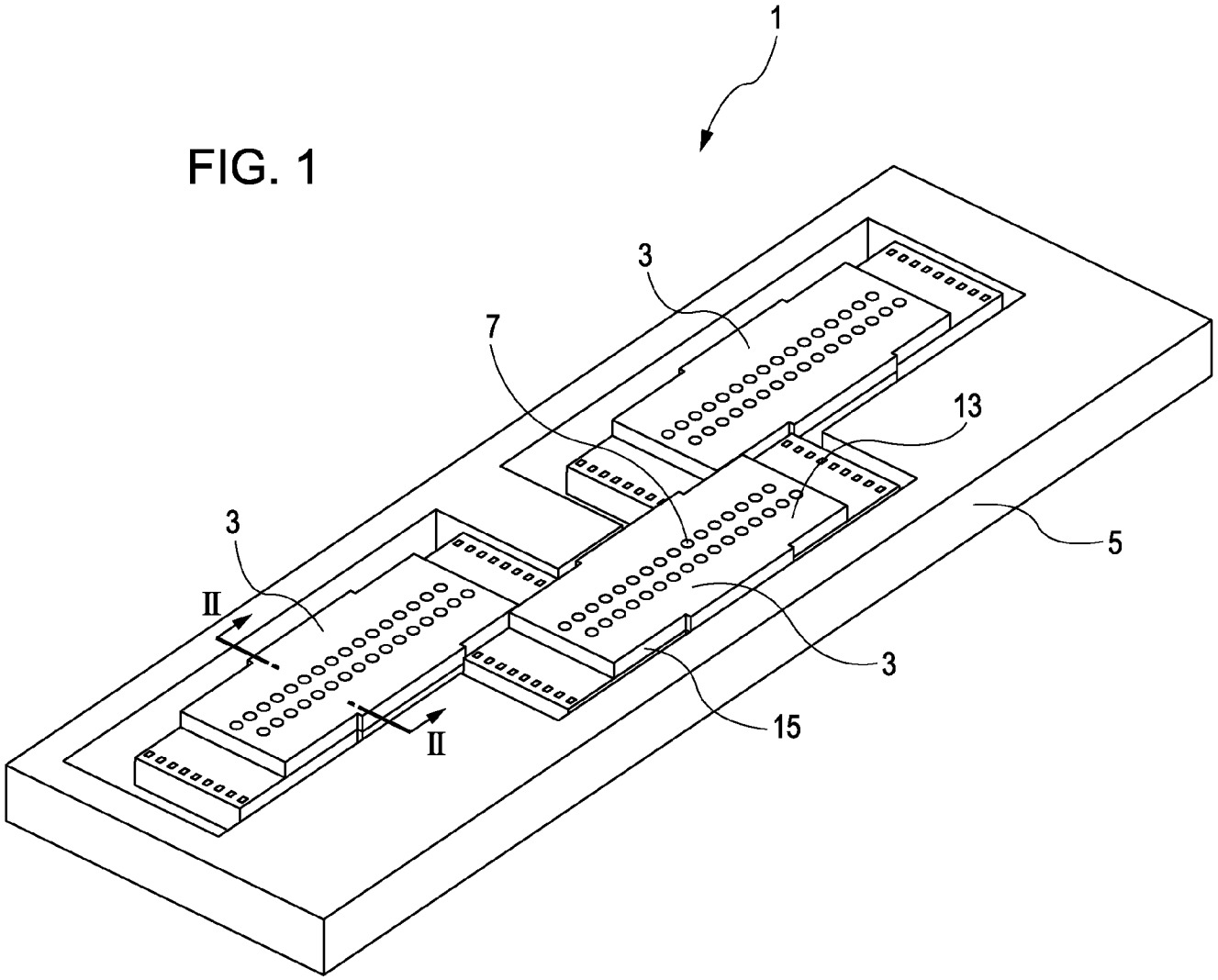
FIG. 1 is a schematic perspective view of an ink-jet recording head according to an exemplary embodiment of the present invention.
Figure 2:
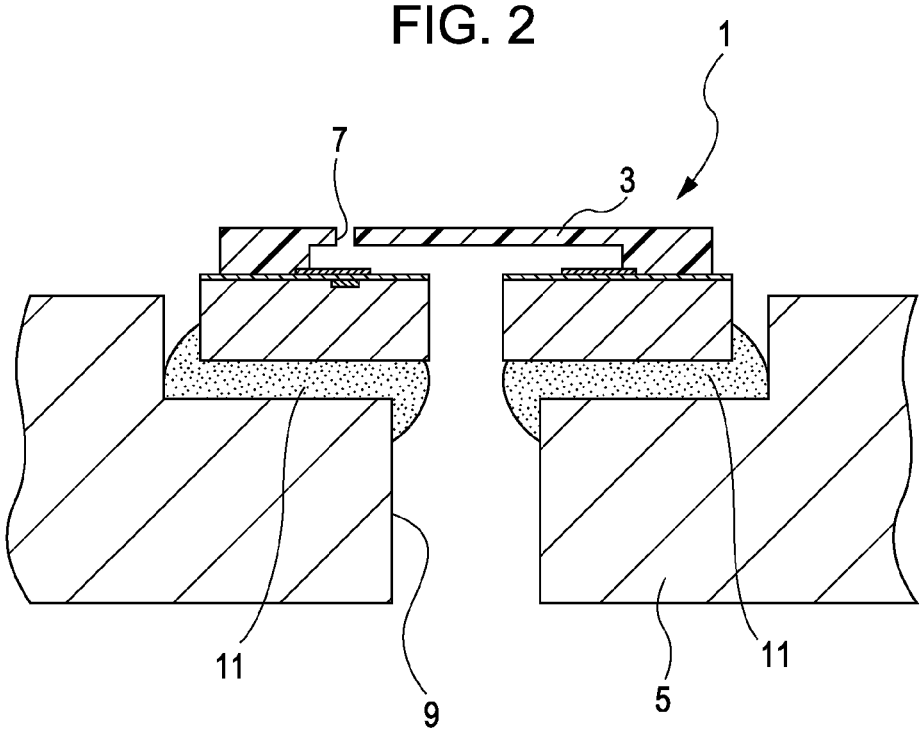
FIG. 2 is a cross-sectional view of the ink-jet recording head taken along line II-II in FIG. 1.

FIG. 1 is a perspective view of an ink-jet recording head 1 according to an exemplary embodiment of the present invention. FIG. 2 is a cross-sectional view of the ink-jet recording head 1 taken along line II-II in FIG. 1. The ink-jet recording head 1 includes a plurality of recording element substrates 3 and a supporting member 5, and each of the recording element substrates 3 is disposed in a corresponding depression formed in the supporting member 5 (see FIG. 1). Furthermore, the recording element substrates 3 each include flow channels (see FIG. 2) through which ink flows and ink discharge ports 7. Ink is supplied from ink supply ports 9 formed in the supporting member 5, and is ejected from the ink discharge ports 7 to a print material through the flow channels of the recording element substrates 3. Moreover, heat-curable adhesives 11 are disposed between the recording element substrates 3 and the supporting member 5 so as to fix the components to each other.

Figure 3:
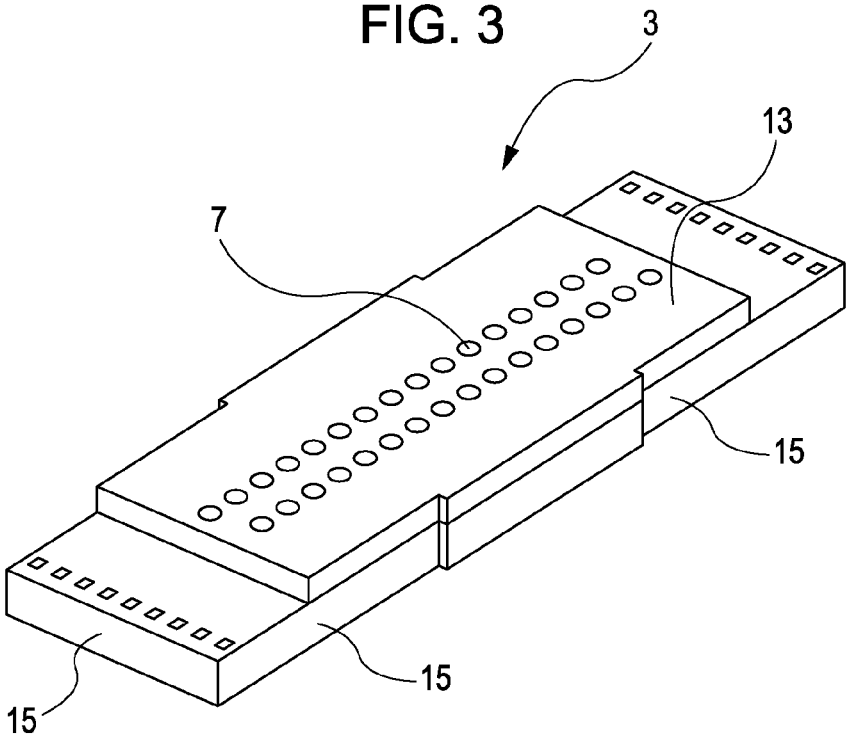
FIG. 3 is a schematic perspective view of a recording element substrate of an ink-jet recording head according to an exemplary embodiment of the present invention.

Next, the structure of the recording element substrates 3 will be described with reference to FIG. 3. Each of the recording element substrates 3 includes a first surface 13, second surfaces 15, and the plurality of flow channels. The flow channels are separated from one another, and ink passes through the flow channels so as to be ejected from the discharge ports 7. The ink discharge ports 7 communicating with the respective flow channels are formed in the first surface 13. The second surfaces 15, intersecting with the first surface 13, form side surfaces of the recording element substrate, and are at least partially formed by etching. The recording element substrate 3 having the above-described structure is substantially a rectangular parallelepiped having cut-off portions at the side surfaces thereof as shown in FIG. 3.

Figure 4A:
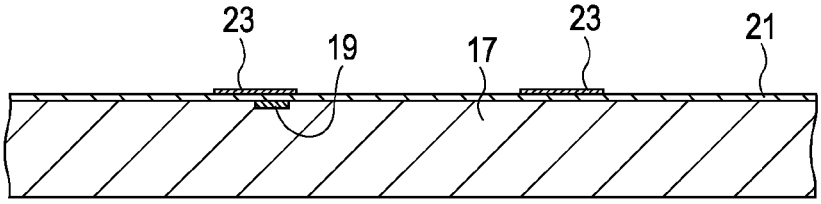
FIGS. 4A to 4E are cross-sectional views illustrating a method for manufacturing the recording element substrate shown in FIG. 3.

The recording element substrate 3 is manufactured as shown in FIGS. 4A to 4E. First, as shown in FIG. 4A, an ejection pressure generating element 19 is disposed on the top surface (main surface) of a substrate member 17 formed of a silicon substrate (<100> crystallographic orientation, thickness of 625 μm), and a silicon nitride layer 21 and a tantalum layer 23 serving as protective films are formed thereon.

Figure 4B:
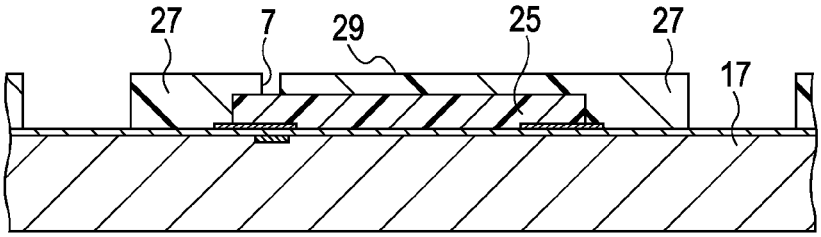

Next, as shown in FIG. 4B, a flow channel pattern is formed using a resist 25, and a flow channel forming member 27 composed of photosensitive epoxy resin and a photosensitive water-repellent layer 29 are formed on the resist in order to form ink flow channels 35 on the substrate member 17. Subsequently, the discharge ports 7 are formed by patterning.

Figure 4C:
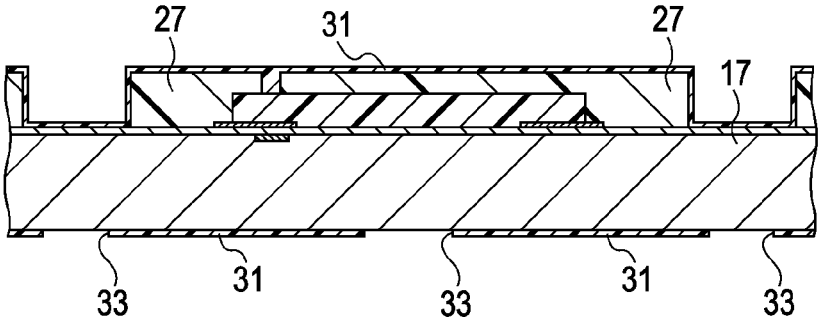
Figure 4D:
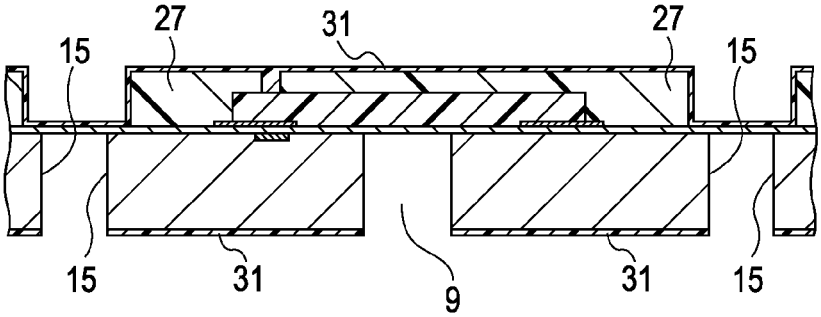

Next, as shown in FIG. 4C, resists 31 are applied on both surfaces of the recording element substrate 3. The resist 31 on the bottom surface functions as a mask for dry etching, and has openings 33 at positions where the ink supply port 9 and the second surfaces (etched surfaces) 15 serving as abutting portions are formed by etching. Next, as shown in FIG. 4D, the ink supply port 9 and the second surfaces 15 serving as the etched surfaces 15 are formed at the same time by dry etching. A reactive ion etching (RIE) machine of the inductively-coupled plasma (ICP) type and $SF_6$ and $C_2F_8$ etching gases are preferably used for the etching.

Figure 4E:
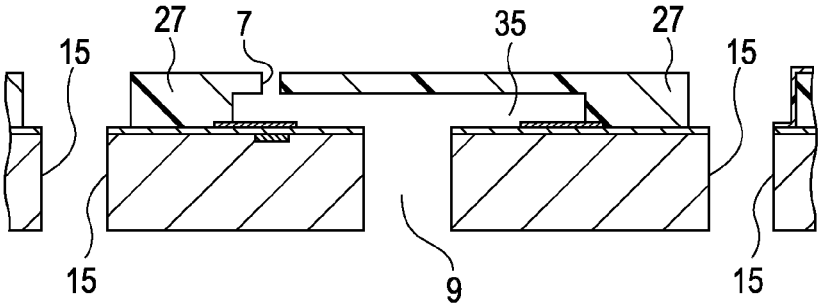
Figure 5:
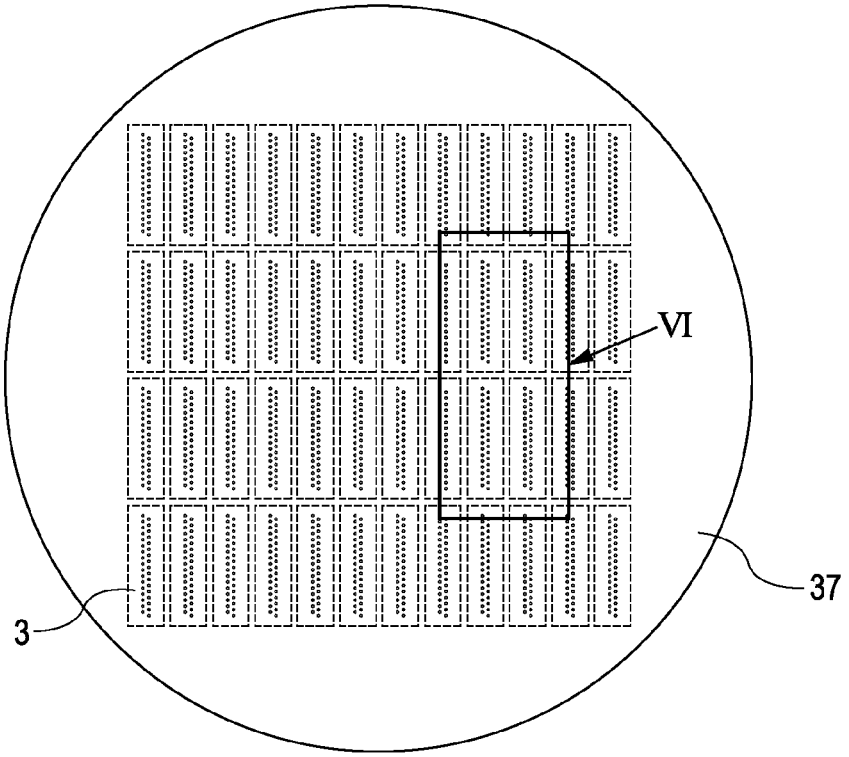
FIG. 5 is a plan view of a silicon substrate on which recording element substrates are formed by the method shown in FIGS. 4A to 4E.
Figure 6:
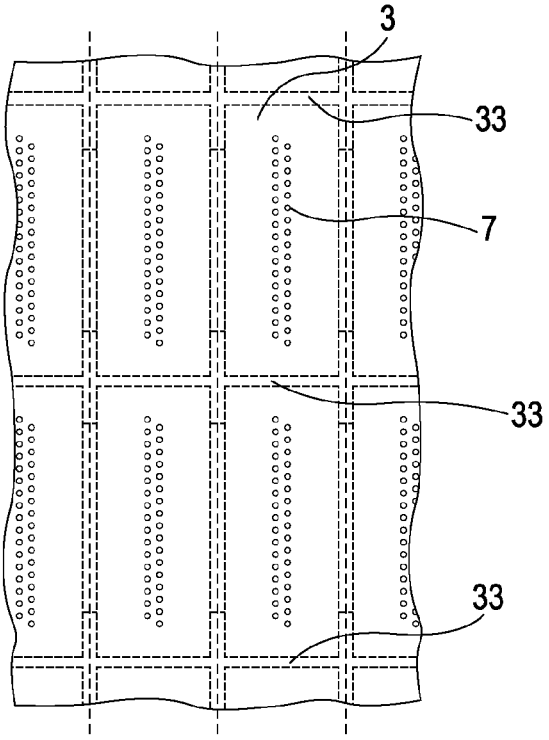
FIG. 6 is an enlarged view of the silicon substrate shown in FIG. 5.

Finally, as shown in FIG. 4E, parts of the silicon nitride layer 21 over the ink supply port 9 and the abutting portions and the resist 25 that forms the flow channels 35 on the substrate member 17 are removed so that the flow channels 35 are formed. Ultimately, multiple recording element substrates 3 as shown in FIG. 5 and FIG. 6, which is an enlarged view of FIG. 5, are cut out of the silicon substrate 37 during the process of dicing. The etched surfaces 15 of each recording element substrate 3 can be formed with an accuracy of several micrometers using the above-described method. Each ejection pressure generating element 19 is connected to a transistor circuit for driving the element and wiring lines (not shown). In the case where a silicon substrate having a <110> crystallographic orientation is used, the ink supply port 9 and the etched surfaces 15 can also be formed by crystal anisotropic etching using a strong alkaline solution such as potassium hydrate and tetramethylammonium hydroxide.

The ink-jet recording head 1 using the recording element substrates 3 manufactured as above is manufactured with the following method.

Figure 7:
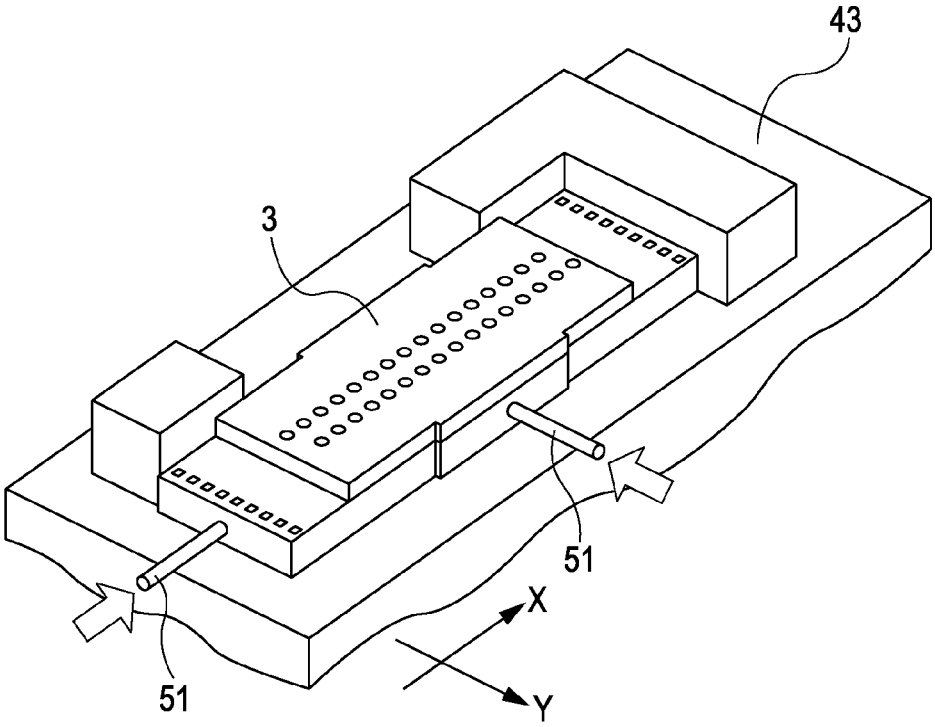
FIG. 7 is a schematic perspective view of a device for assembling an ink-jet recording head according to an exemplary embodiment of the present invention.
Figure 8:
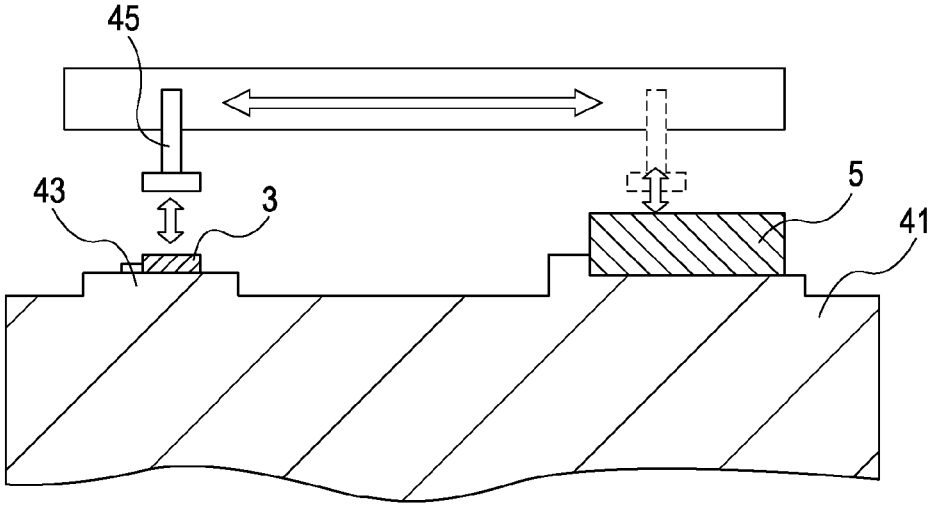
FIG. 8 is a schematic cross-sectional view illustrating a method for positioning a recording element substrate of an ink-jet recording head according to an exemplary embodiment of the present invention.

First, a recording element substrate 3 is disposed on a positioning jig 43 shown in FIG. 7 on an assembling device 41 shown in FIG. 8. The positioning jig 43 has X and Y references for accurately positioning the recording element substrate 3. The recording element substrate 3 is accurately positioned by bringing the etched surfaces 15 of the recording element substrate 3 into contact with the X and Y references of the positioning jig 43 using push pins 51.

Next, as shown in FIG. 8, the accurately positioned recording element substrate 3 is moved to the supporting member 5 using an automatic hand 45, and is disposed on the supporting member 5 via the heat-curable adhesives 11. Herein, the moving distance of the automatic hand 45 is always fixed. At this moment, a plurality of recording element substrates 3 are disposed on the supporting member 5 that supports the recording element substrates 3 so as to be in contact with each other at the second surfaces 15 thereof. These second surfaces 15 function as reference positioning surfaces between the recording element substrates 3. The heat-curable adhesives 11 are cured by being heated while the above-described contact state is maintained so that the recording element substrates 3 are fixed to the supporting member 5.

As another positioning method, a plurality of recording element substrates 3 can be disposed at predetermined positions on the supporting member 5 by bringing the etched surfaces 15 of the recording element substrates 3 into contact with positioning references disposed on the supporting member 5.

According to the ink-jet recording head 1 manufactured as above, the second surfaces 15, intersecting with the first surface 13 having the ink discharge ports 7 and forming the side surfaces of the recording element substrate 3, are at least partially subjected to etching. Since the second surfaces 15 subjected to etching are corrosion-resistant, the surface accuracy of the second surfaces 15 can be ensured. Therefore, the accuracy of the relative positions of a plurality of recording element substrates 3 when they are bonded can be ensured by bringing the recording element substrates 3 into contact with each other at the second surfaces 15 whose surface accuracy is ensured. As a result, the accuracy of the distances between the ink discharge ports arranged in the recording element substrates can also be ensured, and the ink-jet recording head can support the accuracy required for bonding the recording element substrates with densely arranged discharge ports. Thus, variations in accuracy of the positions of the recording element substrates when they are fixed can be markedly improved compared with those in known ink-jet recording heads. Moreover, the ink-jet recording head can be easily manufactured since the accuracy of positions of the recording element substrates 3 when they are bonded can be satisfied without using image processing systems. Furthermore, since the etching openings 33 are formed between the etched surfaces 15 of two adjacent recording element substrates 3 as shown in FIGS. 5 and 6, dicing machines are not required for separating the recording element substrates 3 from one another. This can reduce the tact time for the cutting step, and can improve the lifetime of cutting devices such as dicing machines.

The following modification is possible for fixing the recording element substrates 3 according to the above-described exemplary embodiment on the supporting member 5. That is, positioning portions can be formed on the supporting member 5, and the recording element substrate 3 can be disposed such that the second surfaces 15 thereof are brought into contact with the positioning portions. With this, the plurality of recording element substrates can be positioned with respect to the supporting member, and the positions of the recording element substrates on the supporting member when they are fixed can be ensured without bringing the recording element substrates into contact with each other. Although a full-line recording head having a plurality of recording element substrates was described in the above-described exemplary embodiment, the present invention is not limited to this. For example, the present invention is applicable to a recording head in which a single recording element substrate is positioned by being brought into contact with a positioning portion on a supporting member.

Figure 9A:
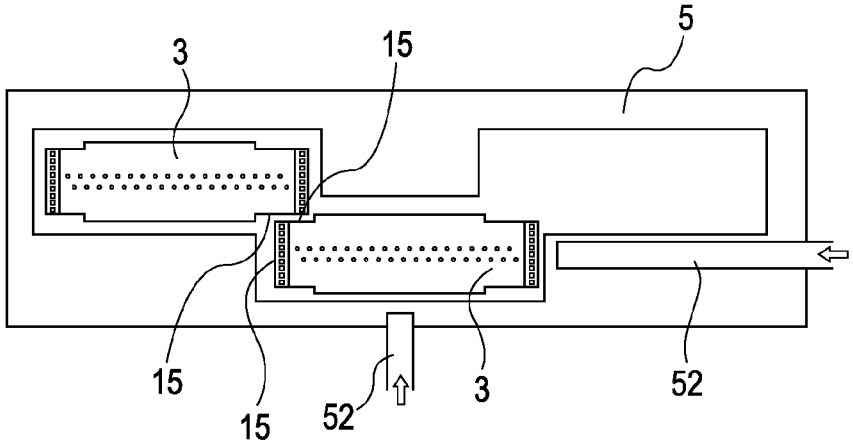
FIGS. 9A to 9C are plan views illustrating a modification of a method for assembling an ink-jet recording head according to an exemplary embodiment of the present invention.
Figure 9B:
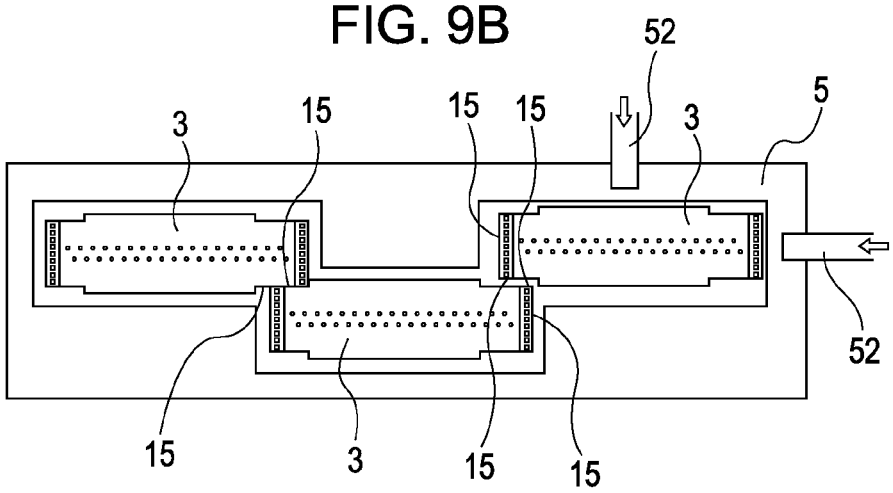
Figure 9C:
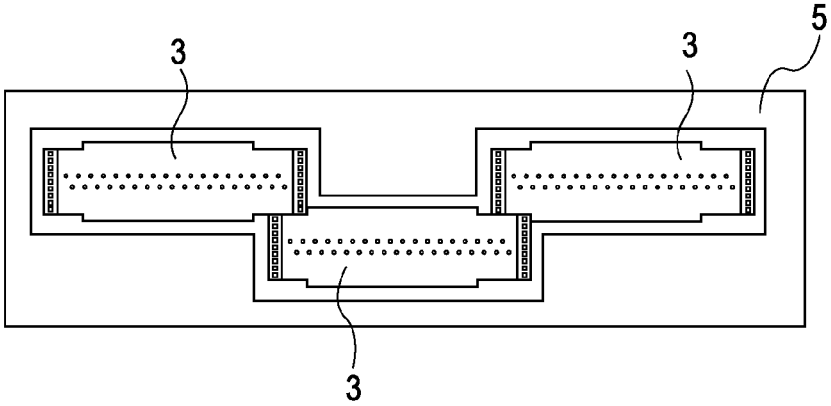

In addition, the recording element substrates 3 can be accurately positioned as follows. That is, as shown in FIG. 9, the recording element substrates 3 can be accurately positioned by bringing the next recording element substrate 3 into contact with the recording element substrate 3 that was previously bonded on the supporting member 5 at the etched surfaces 15 thereof using push pins 52. The recording element substrates 3 are disposed on the supporting member 5 via the heat-curable adhesives 11, and fixed on the supporting member 5 by heating and curing the heat-curable adhesives 11. The accuracy of the positions of the recording element substrates 3 of the ink-jet recording head 1 formed as above when the recording element substrates 3 are fixed is excellent compared with that of the known ink-jet recording heads, and the size of the ink-jet recording head can be reduced since the recording element substrates 3 are positioned by being brought into contact with each other.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. A method for manufacturing a plurality of recording element substrates, the method comprising:

preparing a silicon wafer to include the plurality of recording element substrates, each recording element substrate including energy generating element groups for generating energy used for ejecting a liquid; and dividing, by dry etching, the silicon wafer so as to separate the recording element substrates from each other, each recording element substrate including the energy generating element groups.

2. The method for manufacturing the plurality of recording element substrates according to claim 1, wherein the silicon wafer is provided with a member including a discharge port for discharging a liquid in the preparing the silicon wafer.

3. The method for manufacturing the plurality of recording element substrates according to claim 1, wherein the silicon wafer is divided into the plurality of substrates by dry etching and dicing.

4. The method for manufacturing the plurality of recording element substrates according to claim 1, further comprising fixing the plurality of substrates into which the silicon wafer is divided to a supporting member so that surfaces of adjacent substrates formed by dry etching are opposed to each other.

5. The method for manufacturing the plurality of recording element substrates according to claim 1, wherein the dividing includes dry etching the silicon wafer at a position between adjacent recording element substrates so as to separate the adjacent recording element substrates from each other.

6. The method for manufacturing the plurality of recording element substrates according to claim 1, wherein the dividing includes dry etching the silicon wafer at a position so as to separate the recording element substrates from the silicon wafer.

* * * * *